US006697303B2

(12) United States Patent
Amano et al.

(10) Patent No.: US 6,697,303 B2
(45) Date of Patent: Feb. 24, 2004

(54) DIAL FOR TIMEPIECE, MANUFACTURING METHOD THEREOF AND TIMEPIECE

(75) Inventors: Masao Amano, Yamanashi (JP); Shunji Minami, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 210 days.

(21) Appl. No.: 10/009,526

(22) PCT Filed: Jul. 11, 2001

(86) PCT No.: PCT/JP01/03113

§ 371 (c)(1),
(2), (4) Date: Dec. 11, 2001

(87) PCT Pub. No.: WO01/79939

PCT Pub. Date: Oct. 25, 2001

(65) Prior Publication Data

US 2003/0007425 A1 Jan. 9, 2003

(30) Foreign Application Priority Data

Apr. 13, 2000 (JP) ..... 2000-11537

(51) Int. Cl.[7] ..... G04B 19/30; G04B 19/32; G04B 19/06

(52) U.S. Cl. ..... 368/67; 368/226; 368/227; 368/232

(58) Field of Search ..... 368/67, 226–228, 368/232

(56) References Cited

U.S. PATENT DOCUMENTS 5,426,621 A * 6/1995 Akasaka ..... 368/226
5,838,640 A 11/1998 Sonoda et al.
5,838,644 A * 11/1998 Yoneda et al. ..... 368/232
5,880,796 A 3/1999 Sonoda et al.
5,930,204 A 7/1999 Sonoda et al.
6,020,943 A 2/2000 Sonoda et al.
6,208,591 B1 3/2001 Sakurazawa et al.
6,266,297 B1 7/2001 Sonoda et al.
6,512,721 B1 * 1/2003 Amano et al. ..... 368/67

FOREIGN PATENT DOCUMENTS

DE 1 191 592 12/1960

OTHER PUBLICATIONS

Patent Abstracts of Japan, vol. 1999, No. 09; Jul. 30, 1999 & JP 11–095698 (Casio Computer Co., Ltd.) Apr. 9, 1999 & USP 6,208,591 (Casio Computer Co., Ltd.) Mar. 27, 2001.

* cited by examiner

*Primary Examiner*—Vit Miska
(74) *Attorney, Agent, or Firm*—Frishauf, Holtz, Goodman & Chick, P.C.

(57) ABSTRACT

With a dial for a timepiece comprising a decoration member 21 having a plurality of through holes 22 formed vertically on a luminescent member 10, the cross-sectional area of lower-side holes 24 of the decoration member 21 is formed to be larger than that of upper-side holes 23. Therefore, even if a substrate is thick, the diameter of the upper-side holes 23 of the through holes 22 can be formed to be small sufficiently. Moreover, compared to a dial size 20 for a timepiece wherein the decoration member 21 is placed on the luminescent member 10, the diameter of the through holes 22 of the decoration member 21 is small. Thus, it is possible to take in enough light from the luminescent member 10 through the lower-side holes 24 to ensure the sufficient amount of light through the through holes 22. It is possible to obtain sufficient illuminance for the dial.

15 Claims, 11 Drawing Sheets

DIAL FOR TIMEPIECE, MANUFACTURING METHOD THEREOF AND TIMEPIECE

This application is a U.S. National Phase Application under 35 USC 371 of International Application PCT/JP01/03113 (published in English) filed Apr. 11, 2001.

BACKGROUND OF THE INVENTION

1. Field of the Invention

The present invention relates to a dial for a timepiece, a manufacturing method thereof and a timepiece.

2. Description of the Related Art

According to an earlier development, there is a dial for a timepiece, such as a wristwatch, comprising a luminescent member made of an EL element (Electro Luminescent element) for emitting light to enable users to recognize time even in a dark place.

As this type of a dial for a timepiece, for example, there is one that comprises a decoration member having a plurality of through holes on a luminescent member so that the luminescent member emits light upwards through each of the through holes for illuminating the upper surface of the decoration member. There are U.S. Pat. Nos. 5,838,640, 5,930,204, 5,880,796 and 6,020,943 and U.S. patent application Ser. No. 09/323,449 (now U.S. Pat. No. 6,266,297), Ser. No. 09/152,410 (now U.S. Pat. No. 6,208,591) and Ser. No. 09/702,259, as earlier developments of the present invention.

One problem encountered in such a dial is the through holes. If the diameter of the through holes is small, the light from the luminescent member cannot pass through them enough to illuminate the dial, so that the dial becomes dark. On the other hand, the through holes with a large diameter become so visible that the appearance of the dial leads sense of incongruity.

The object of the present invention is to emit light from the luminescent member upwards effectively and to make the through holes discreet enough to improve a good showing.

SUMMARY OF THE INVENTION

The present invention was developed to solve the above-described problem. According to a first aspect of the present invention, a dial (20, 29) comprises a decoration member (21) that has a plurality of through holes (22) formed vertically and is provided on an upper surface of a luminescent member (10). Moreover, the through holes are formed so that the cross-sectional area of holes (24, 27, 28) that is a lower surface side portion of the through holes is larger than the cross-sectional area of holes (23) that is an upper surface side portion of the through holes.

According to the invention, the cross-sectional area of the lower-side holes of the through holes is larger than the cross-sectional area of the upper-side holes. Therefore, the upper-side holes can be formed to be so small that the through holes are discreet from above, when the decoration member is used for a dial. As a result, the dial can have a good showing. Furthermore, it is possible to sufficiently take in light from the luminescent member through the lower-side holes. Therefore, even if the diameter of the upper-side holes is small, the enough amount of light can pass through the through holes to obtain the sufficient intensity of illumination. As a result, the upper portion of the decoration member can be illuminated brightly.

A second aspect of the invention is a manufacturing method of a dial for a timepiece comprising two processes, as shown in FIGS. 3A–3D and 9A–9D. According to the first process, masks (25, 26, 35, 36) are provided to cover both upper and lower surfaces of a substrate 15. The masks have openings (25*a*, 35*a*) on the upper surface and openings (26*a*, 36*a*) on the lower surface so that the upper-side openings (25*a*, 35*a*) corresponds to the lower-side openings (26*a*, 36*a*). Moreover, the upper-side openings (25*a*, 35*a*) are smaller than the lower-side openings (26*a*, 36*a*). Therefore, a plurality of through holes are formed on the substrate by etching from both surfaces to provide a decoration member (21, 31, 41). According to the second process, the decoration member is mounted on an upper surface of a luminescent member (10).

According to the invention, a substrate is provided with masks having openings on both surfaces, wherein the upper-side openings are formed at the positions corresponding to the lower-side openings. Thus, through holes are formed at positions corresponding to the openings by etching from both surfaces. Therefore, even if a substrate is thick, it is possible to provide smaller through holes than that provided by etching from only one side. As a result, the through holes can be formed to be discreet.

BRIEF DESCRIPTION OF THE DRAWINGS

FIGS. 3A to 3D show the process for manufacturing the dial of FIG. 2: wherein FIG. 3A is a cross-sectional view showing the principal portion of a substrate with masks provided on both upper and lower surfaces of a substrate; FIG. 3B is a cross-sectional view showing the principal portion when both upper and lower surfaces of the substrate are being etched; FIG. 3C is a cross-sectional view showing the principal portion of a decoration member that is obtained by removing the masks from the substrate after etching; and FIG. 3D is a cross-sectional view of the principal portion of the decoration member fixed on an upper side of a luminescent member and comprising a protective film provided on the decoration member;

FIGS. 9A to 9D show a process for manufacturing the dial of FIG. 8: wherein FIG. 9A is a cross-sectional view showing the principal portion of a substrate with masks provided on both upper and lower surfaces; FIG. 9B is a cross-sectional view showing the principal portion when both upper and lower surfaces of the substrate are being etched; FIG. 9C is a cross-sectional view showing the principal portion of a decoration member that is obtained by removing the masks from the substrate after etching; and FIG. 9D is a cross-sectional view showing the principal portion of the decoration member fixed on an upper side of a luminescent member and comprising a protective film provided on the decoration member;

PREFERRED EMBODIMENTS OF THE INVENTION

First Embodiment

Hereinafter, a first embodiment of the present invention applied to a wristwatch will be explained, with reference to FIG. 1 to FIGS. 3A to 3D.

Figure 1:
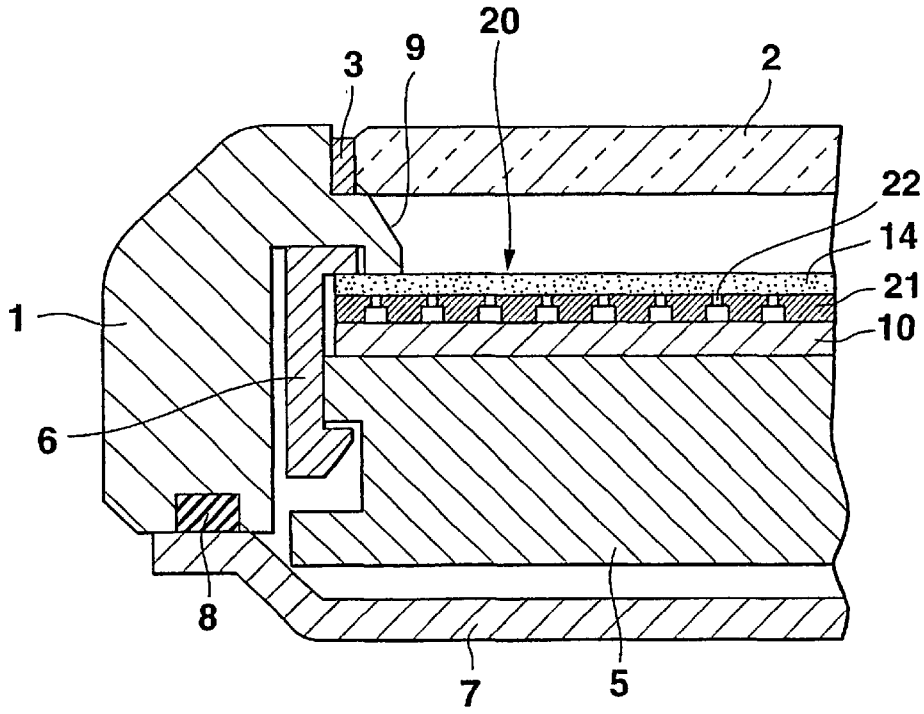
FIG. 1 is an enlarged cross-sectional view showing the principal portion of a first embodiment of the present invention applied to a wristwatch.

FIG. 1 is an enlarged cross-sectional view of the principal portion showing the inner structure of the wristwatch. The wristwatch comprises a case complete 1. A watch glass 2 is mounted on the case complete 1 with a packing 3 between them. A dial 20 for a timepiece and a watch module 5 that are attached to a movement holder 6 are incorporated inside the case complete 1. Moreover, a case back 7 is attached to the bottom of the case complete 1 with a waterproof ring 8 between them.

The watch module 5 has an analogue function and may have a digital function. The watch module 5 is designed to make hands (not shown) move above the dial 20. A dial cover 9 covering the top of the movement folder 6 and fitted on the periphery of the dial 20 is provided inside the case complete 1 to protrude inward.

Figure 2:
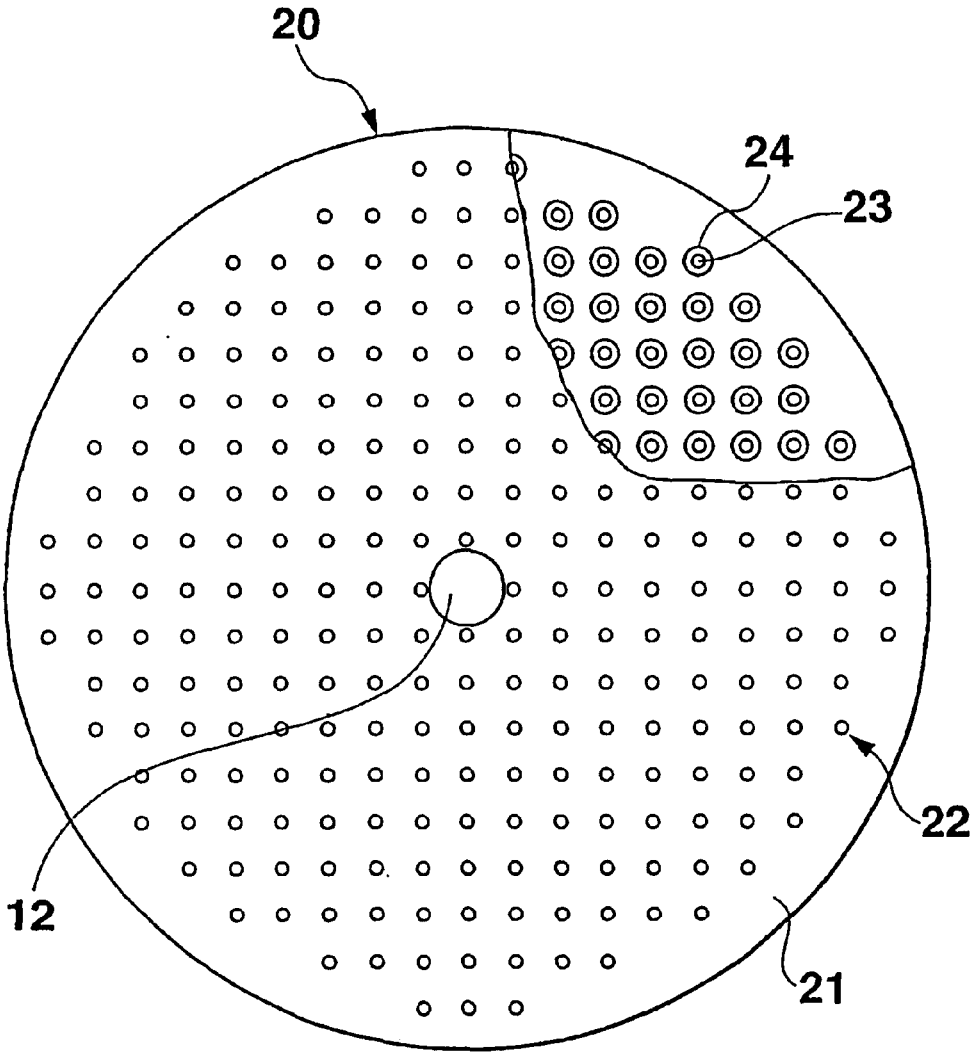
FIG. 2 is a front elevation showing a dial for the timepiece of FIG. 1, wherein a decoration member thereof is partly shown from the backside.

The dial 20 is structured as a bilayer comprising a luminescent member 10 mounted on the watch module 5 and a decoration member 21 mounted on the luminescent member 10, as shown in FIG. 1. Moreover, the whole dial 20 has a circular shape, as shown in FIG. 2.

The luminescent member 10 is a flat illuminant made of a luminescence element, such as EL element, and electrically connected to an electrode (not shown) of the watch module 5. A hand shaft hole (not shown) for inserting hands (not shown) of the watch module 5 is provided at the center of the luminescent member 10.

The decoration member 21 is a flat circular plate made of metal, such as a stainless steel. A hand shaft hole 12 is provided at the center of the decoration member 21 to correspond to the hand shaft hole of the luminescent member 10, as shown in FIG. 2. Moreover, a large number of through holes 22 perforating vertically are formed in the decoration member 21. In this case, the diameter of the through holes 22 is formed to be smaller than the thickness of the decoration member 21 that is approximately 0.1 mm. A large number of the through holes 22 can be arranged to have a radial, concentric circular or striped pattern. Furthermore, a protective film 14 that is transparent or semitransparent is flatly provided over an upper surface of the decoration member 21 for protecting the upper surface of the decoration member 21 from corrosion and damage.

Holes 23 that are upper portions of the through holes 22 and holes 24 that are lower portions of the through holes 22 differ in size. In other words, a plurality of the through holes 22 are provided in the decoration member 21 so that both upper-side holes 23 of the substrate 15 and lower-side holes 24 of the substrate 15 become circular, as shown in FIG. 2. However, the lower-side holes 24 are processed to have a larger diameter than the upper-side holes 23, as shown in FIG. 3D. Therefore, the through holes 22 are in the shape of an uneven column wherein the diameter of the upper-side holes 23 and the diameter of the lower-side holes 24 differ.

Next, the method for manufacturing such a dial 20 for a timepiece will be explained with reference to FIG. 3A to FIG. 3D.

Figure 3A:
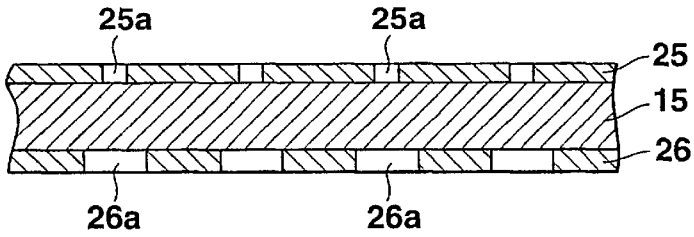

Firstly, as shown in FIG. 3A, resist, such as photosensitive resin, as a masking material is applied on both upper and lower surfaces of a stainless-steel substrate 15 for the decoration member 21. The resist is developed by exposure to light to remove the resist at the position where the through holes 22 will be formed. As a result, masks 25 or 26 having openings 25*a* or 26*a* at the positions where the though holes 22 will be formed are provided on both upper and lower surfaces of the substrate 15. In this case, the upper-side mask 25 has the small-diameter openings 25*a* corresponding to the upper-side holes 23 so that the upper surface of the substrate 15 is partly exposed through the openings 25*a*. Furthermore, the mask 26 at the lower surface has the large-diameter openings 26*a* corresponding to the holes 24. Hence, the lower surface of the substrate 15 is partly exposed through the openings 26*a*. The openings 25*a* of the mask 25 on the upper surface of the substrate 15 are formed at the position corresponding to the openings 26*a* of the mask 26 on the lower surface.

Figure 3B:
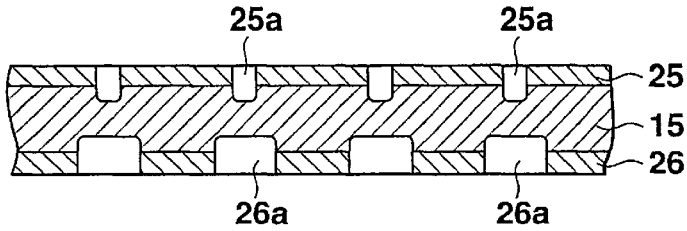
Figure 3C:
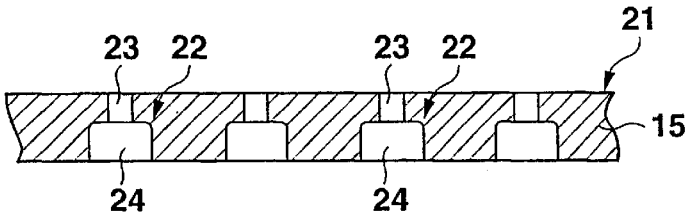
Figure 3D:
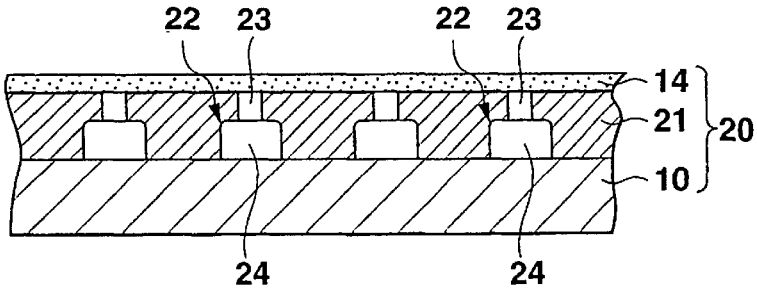

Secondly, the substrate 15 having the masks 25 and 26 is etched from both upper and lower surfaces, and then the portions of the substrate 15 exposed through the openings 25*a* and 26*a* are removed, as shown in FIG. 3B. After the exposed portions of the substrate 15 are removed to connect each other, the masks 25 and 26 are taken off from the surfaces of the substrate 15. Thus, the through holes 22 are formed in the substrate 15. The through holes 22 are in the shape of an uneven column wherein the upper-side holes 23 and the lower-side holes 24 differ in size, as shown in FIG. 3C. As a result, it is possible to obtain the decoration member 21 having a plurality of the through holes 22. Therefore, as shown in FIG. 3D, the decoration member 21 is fixed on the upper surface of the luminescent member 10, and the protective film 14 is applied on the upper surface of the decoration member 21. As a result, the dial 20 for a timepiece can be obtained.

According to such a method for manufacturing the dial 20, the masks 25 and 26 having the openings 25*a* and 26*a* that differ in size are provided on the upper and lower surfaces of the substrate 15. Therefore, the through holes 22 are provided at the positions corresponding to the openings 25*a* and 26*a* by etching from both surfaces. As a result, even if the substrate 15 is thick, the upper-side holes 23 of the through holes 22 can be formed so that the diameter becomes small sufficiently. Particularly, when the substrate 15 is etched from both upper and lower surfaces to form the through holes 22, it is possible to form the through holes 22 properly with the upper-side holes 23 and the lower-side holes 24 connected each other, because the diameter of the lower-side holes 24 is larger than that of the upper-side holes 23. Therefore, it is possible to prevent defective products with the upper-side holes 23 not corresponding to the lower-side holes 24. Thus, the productivity can be improved.

According to such a dial 20, the light from the luminescent member 10 is emitted upwards across the protective film 14 through a plurality of the through holes 22 in the decoration member 21. It is possible to illuminate the upper portion of the decoration member 21. Moreover, the upper-side holes 23 of the through holes 22, which are formed on the upper surface of the decoration member 21, can be small enough to be discreet from above. As a result, the decoration effect can be improved. Particularly, because the diameter of the lower-side holes 24 is formed to be larger than that of the upper-side holes 23, it is possible to take in enough light from the luminescent member 10 through the lower-side holes 24. Therefore, the enough amount of the light can be transmitted. Thus, it is possible to obtain the sufficient luminance for illuminating the dial, even if the upper-side holes 23 are small. Furthermore, the dial 20 can have different decoration effects by using the decoration member 21 turned over, because the diameters of the upper-side holes 23 and the lower-side holes 24 differ in size.

Figure 4:
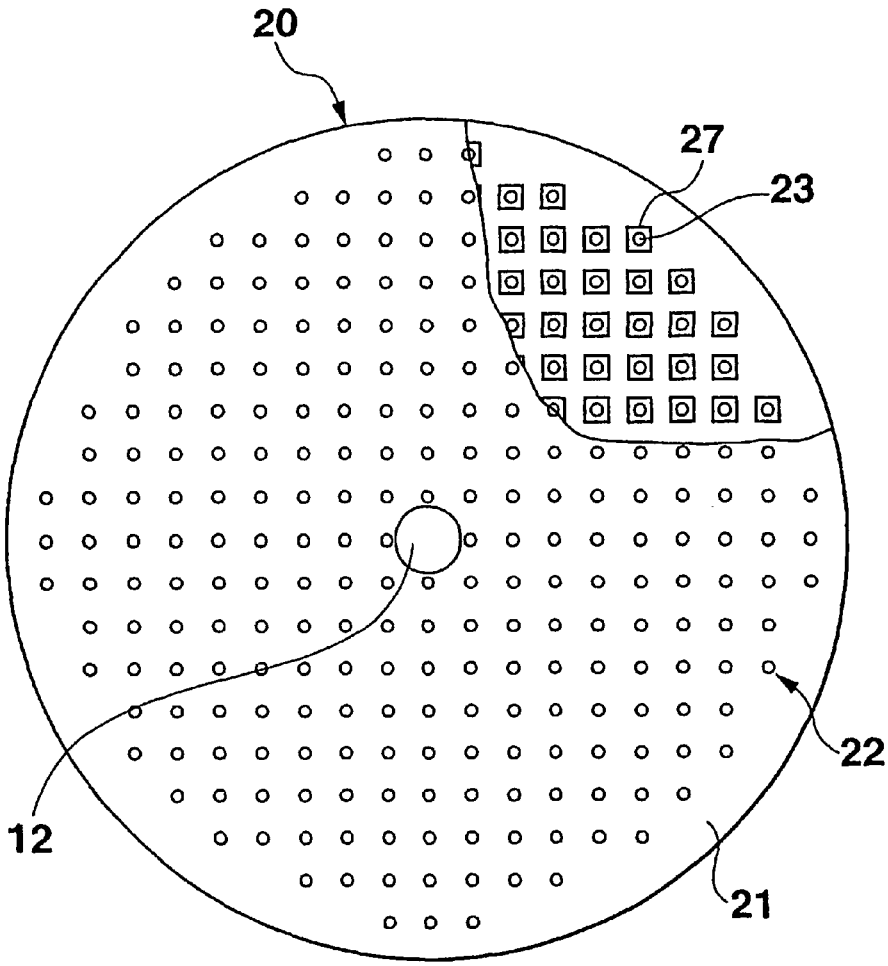
FIG. 4 is a front elevation showing a dial for a timepiece according to a first modification of the first embodiment, wherein a decoration member is partly shown from the backside.
Figure 5:
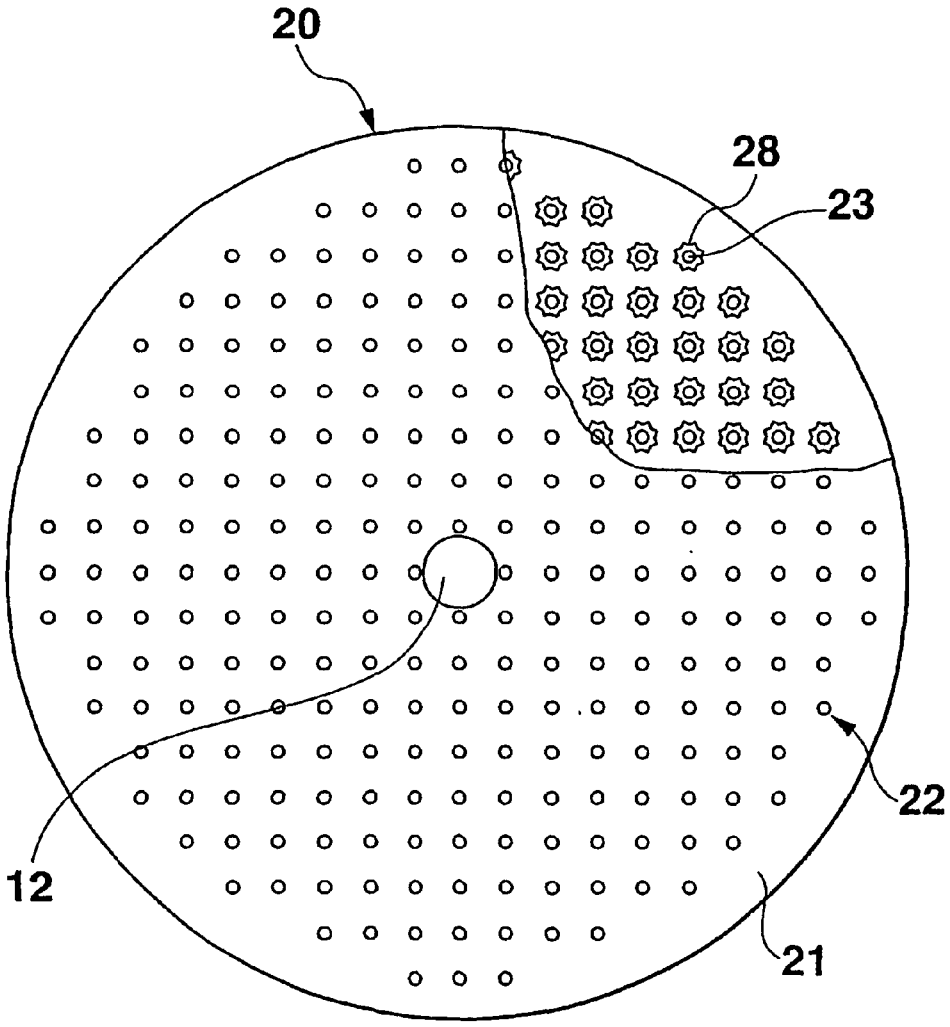
FIG. 5 is a front elevation showing a dial for a timepiece according to a second modification of the first embodiment, wherein a decoration member is partly shown from the backside.

In accordance with the first embodiment described above, both of the upper-side holes 23 and the lower-side holes 24 are formed to be circular. However, the shapes of those holes can be formed to be different from each other, as shown in FIGS. 4 and 5. In other words, according to the through holes 22 of a first modification shown in FIG. 4, the upper-side holes 23 are formed to be in the shape of the circle with the same size as the first embodiment, while lower-side holes 27 are formed to be in the shape of a square whose area is larger than that of the holes 23. According to the through holes 22 of a second modification as shown in FIG. 5, the holes 23 at the upper side are formed to be in the shape of the circle with the same size as the first embodiment, while the holes 28 at the lower side are formed to be in the shape of a toothed wheel or a flower whose area is larger than that of the holes 23. The first modification and the second modification have the same effect as the first embodiment has.

Figure 6:
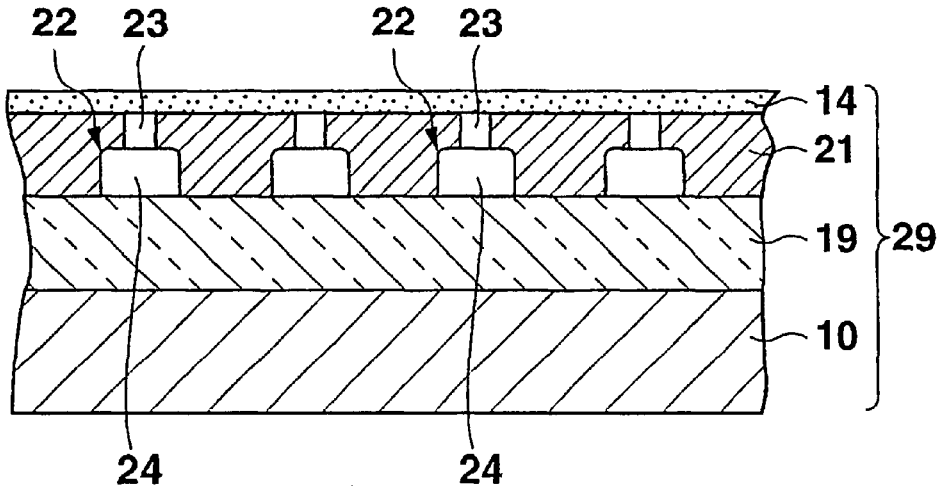
FIG. 6 is an enlarged cross-sectional view showing the principal portion of a dial for a timepiece according to a third modification of the first embodiment.

The dial 20 according to the first embodiment and the modifications thereof comprises the decoration member 21 that is directly mounted on the upper surface of the luminescent member 10. However, the dial can have the structure of a third modification as shown in FIG. 6, as an example. That is, the dial 29 for a timepiece of the third modification as shown in FIG. 6 has the three-layer structure wherein a transparent member 19 is provided on the upper surface of the luminescent member 10 and the decoration member 21 is provided on the upper surface of the transparent member 19. The dial 29 having such a structure also has the effect of the first embodiment. Moreover, the strength of the dial 29 can be enhanced by mounting the transparence member 19.

Figure 7:
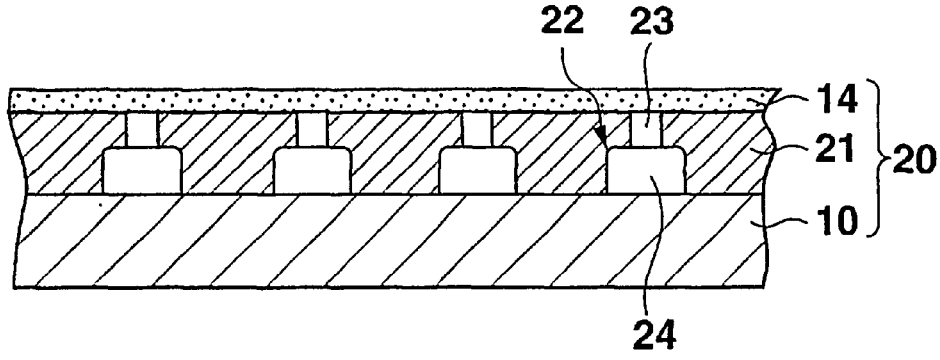
FIG. 7 is an enlarged cross-sectional view showing the principal portion of a dial for a timepiece according to a forth modification of the first embodiment.

According to the first embodiment described above, the depth of upper-side holes 23 of the through hole 22 is equal to that of lower-side holes 24. However, the lower-side holes 24 can be formed to be deeper than the upper-side holes 23, as shown in FIG. 7. For an example, the depth of the upper-side holes 23 can be approximately one third of the thickness of the substrate, and the depth of the lower-side holes 24 can be approximately two third of the thickness of the substrate. As a result, the diameter of the upper-side holes 23 at the upper surface side can be formed to be even smaller.

Second Embodiment

Next, a second embodiment of the present invention applied to a wristwatch will be explained with reference to FIG. 8 and FIGS. 9A to 9D. In these figures, the same reference numerals are attached to the same portions as the first embodiment shown in FIG. 1 to FIGS. 3A to 3D.

A dial 30 for a timepiece of the wristwatch has the same structure as the first embodiment except for the sizes and relationship of holes 33 placed at the upper side and holes 34 placed at the lower side of through holes 32 of a decoration member 31.

Figure 8:
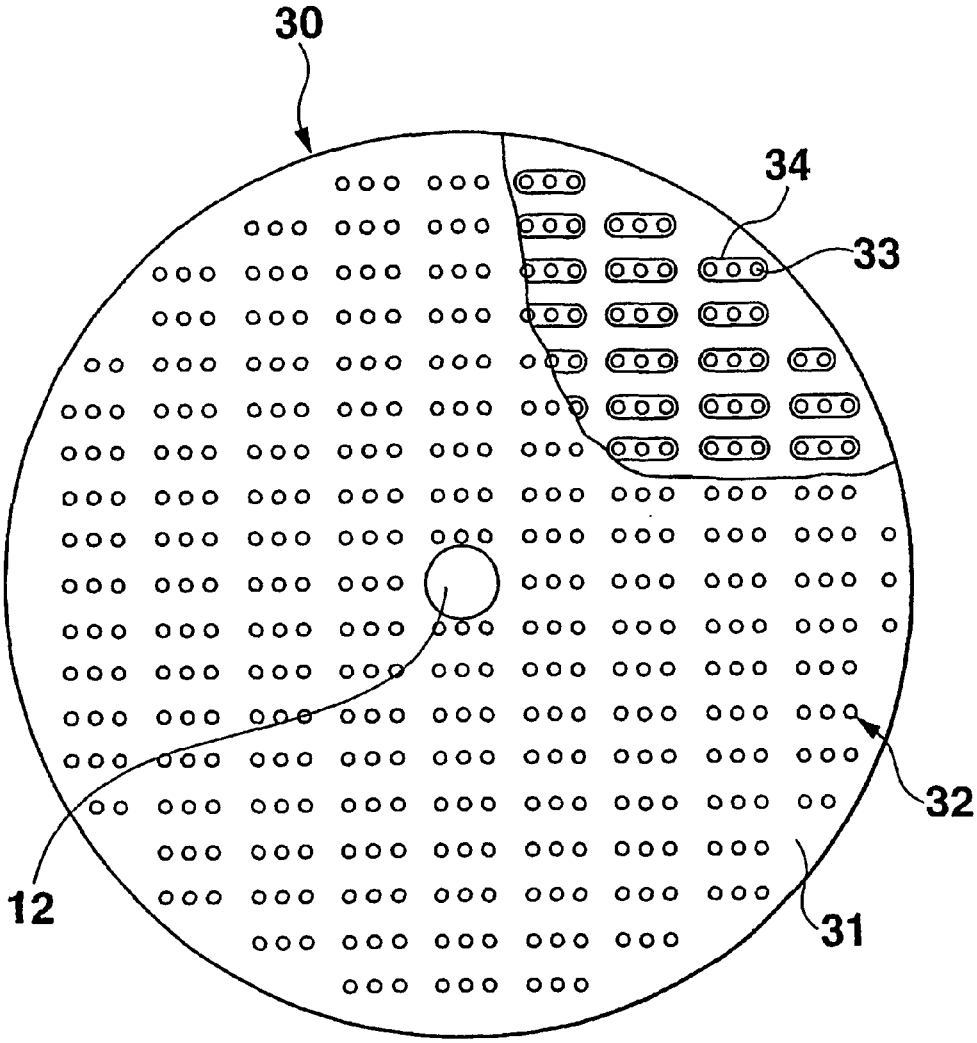
FIG. 8 is a front elevation showing a dial for a timepiece with a decoration member partly shown from the backside, according to a second embodiment of the present invention applied to a wristwatch.

That is, as shown in FIG. 8, a plurality of the through holes 32 are formed in the decoration member 31 so that the cross-sectional area of the lower-side holes 34, formed in the substrate 15 for the decoration member, is larger than the cross-sectional area of the upper-side holes 33. Moreover, three upper-side holes 33 are formed to be within the area of a single lower-side hole 34. In this case, as shown in FIG. 8, the holes 33 are formed to be circular with the diameter equal to or slightly smaller than that of the first embodiment. The lower-side holes 34 are formed to be in the shape of a long hole or an ellipse so that the area thereof is large enough to have three upper-side holes 33.

Next, the method of manufacturing such a dial 30 for a timepiece will be explained with reference to FIGS. 9A to 9D.

Figure 9A:
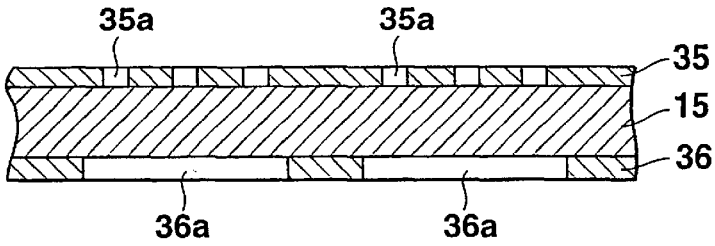

Firstly, as shown in FIG. 9A, resist, such as photosensitive resin as a masking material is applied on both the upper and lower surfaces of a stainless-steel substrate 15 for the decoration member 31. The resist is developed by exposing to light to remove the resist at the position where the through holes 32 will be formed. As a result, masks 35 and 36 having openings 35*a* or 36*a* at the positions where the though holes 32 will be formed are provided on both upper and lower surfaces of the substrate 15. In this case, the upper-side mask 35 has the small-diameter openings 35*a* corresponding to the upper-side holes 33. Therefore, the upper surface of the substrate 15 is exposed through the small openings 35*a*. Furthermore, the openings 36*a* having the large cross-sectional areas are formed on the lower-side mask 36 to correspond to the lower-side holes 34 of the through holes 32. Therefore, the lower surface of the substrate 15 is partly exposed through the large openings 36*a*. The openings 35*a* on the upper-side mask 35 are formed to be correspond to the openings 36*a* on the lower-side mask 36, and three small-diameter openings 35*a* on the upper surface correspond to a single opening 36*a* on the lower surface.

Figure 9B:
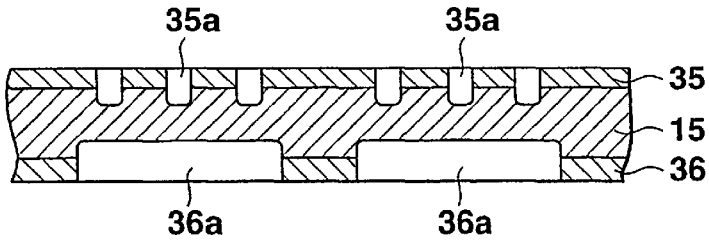
Figure 9C:
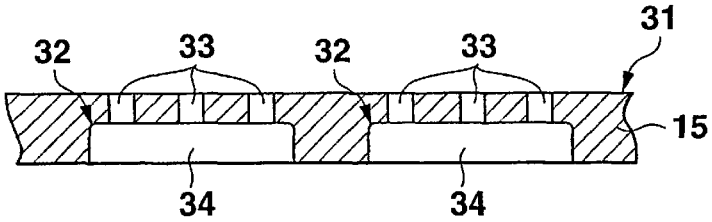
Figure 9D:
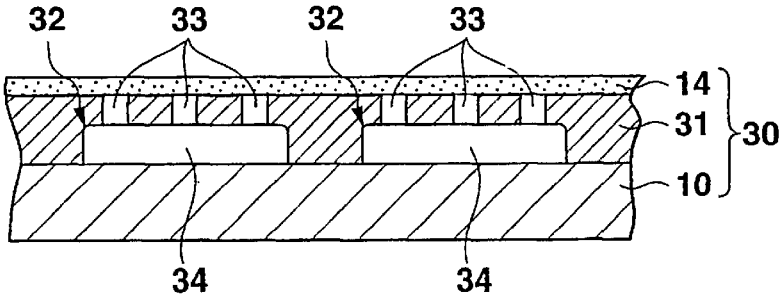

Secondly, the substrate 15 having the masks 35 and 36 is etched from both surfaces. Thus, the portions of the substrate 15 exposed through the openings 35*a* and 36*a* are removed by etching from both sides, as shown in FIG. 9B. After the exposed portions of the substrate are removed to penetrate vertically, the masks 35 and 36 are taken off from the surfaces of the substrate. Therefore, the uneven through holes 32 wherein three upper-side holes 33 correspond to a single lower-side hole 34 are formed in the substrate 15, as shown in FIG. 9C. Thus, it is possible to obtain a decoration member 31 having a plurality of the through holes 32. Furthermore, the decoration member 31 is fixed on the luminescent member 10, and the protective film 14 is applied on the decoration member 31. As a result, the dial for a timepiece 30 can be obtained.

According to the method for manufacturing such a dial 30 for a timepiece the diameter of the upper-side holes 33 of the through holes 32 can be formed to be sufficiently small, even if the substrate 15 is thick, like the first embodiment. Moreover, the cross-sectional areas of the lower-side holes 34 are formed to be larger than that of the upper-side holes 33, while three holes 33 correspond to a single hole 34. Therefore, it is possible to prevent defects in making the through holes 32 caused by gaps between the holes 33 and the holes 34, when the through holes 32 are formed by etching the substrate 15 from both surfaces. As a result, the productivity can be improved. Furthermore, the number of openings 35*a* on the upper-side mask 35 corresponding to a single openings 36*a* on the lower-side mask 36 can be changed accordingly by changing only the upper-side mask 35 without changing the lower-side mask 36. For example, the number of openings 35*a* on the upper-side mask 35 corresponding to a single openings 36*a* on the lower-side mask 36 can be one or two. As another example, each opening 36*a* on the lower-side mask 36 can have the different number of openings 35*a* on the upper-side mask 35.

According to such a dial 30, it is possible to illuminate the upper portion of the decoration member 31 while the through holes 32 in the decoration member 31 are discreet from above, like the first embodiment. Moreover, as well as the first embodiment, enough light from the luminescent member 10 can be taken in through the lower-side holes 34. Therefore, it is possible to obtain the sufficient illumination. In addition, it is possible to obtain a different decoration effect by using the decoration member turned over. Particularly, the amount of the transmitted light can be changed accordingly by changing the number of upper-side holes 33 corresponding to a single lower-side hole 34. Thus, the intensity of illumination can be changed According to the second embodiment described above, the lower-side holes 34 are formed so that a single lower-side hole 34 corresponds to three upper-side holes 33. However, the lower-side holes 34 can be formed more widely so that a single lower-side hole 34 corresponds to four or more upper-side holes 33. Moreover, the shape of the holes 34 is not limited to a long hole or an ellipse, and then it can be a polygon, such as a triangle or a square, or a circle.

Figure 10:
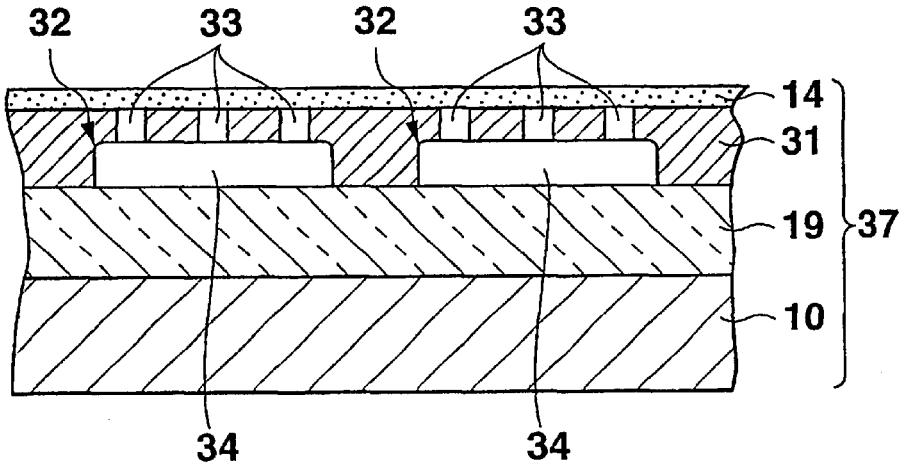
FIG. 10 is an enlarged cross-sectional view showing the principal portion of a dial for a timepiece according to a first modification of a second embodiment.

Furthermore, the dial 30 according to the second embodiment described above and the modifications thereof has the structure wherein the decoration member 31 is directly mounted on the upper surface of the luminescent member 10. However, the dial 30 may have a different structure as shown in FIG. 10. That is, the dial 37 shown in FIG. 10 has the three-layer structure wherein the transparent member 19 used for the first embodiment is provided on the luminescent member 10 and the decoration member 31 is provided on the transparent member 19. The dial 37 having such a structure also has the effect of the second embodiment. Moreover, the strength of the dial 37 can be enhanced by the transparent member 19. As a result, it is possible to obtain the high strength as well as the third modification of the first embodiment.

Figure 11:
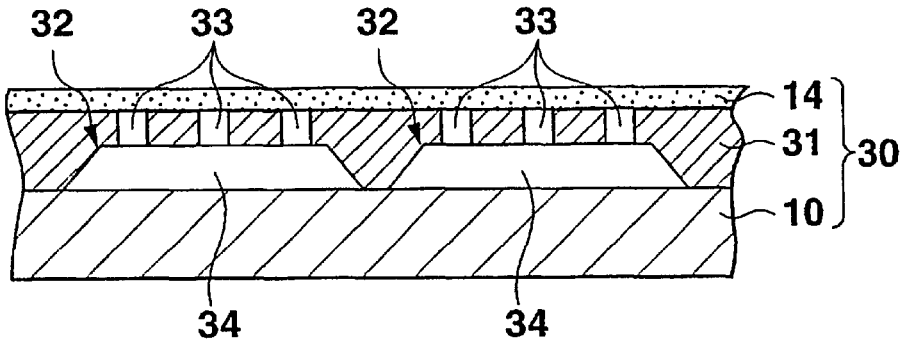
FIG. 11 is an enlarged cross-sectional view showing the principal portion of a dial for a timepiece according to a second modification of the second embodiment.

According to the second embodiment, the walls of the lower-side holes 34 are formed vertically, as shown in FIG. 11. However, if the walls are formed diagonally, it is possible to take in light from the luminescent member 10 effectively for the upper-side holes 33.

Third Embodiment

Figure 12:
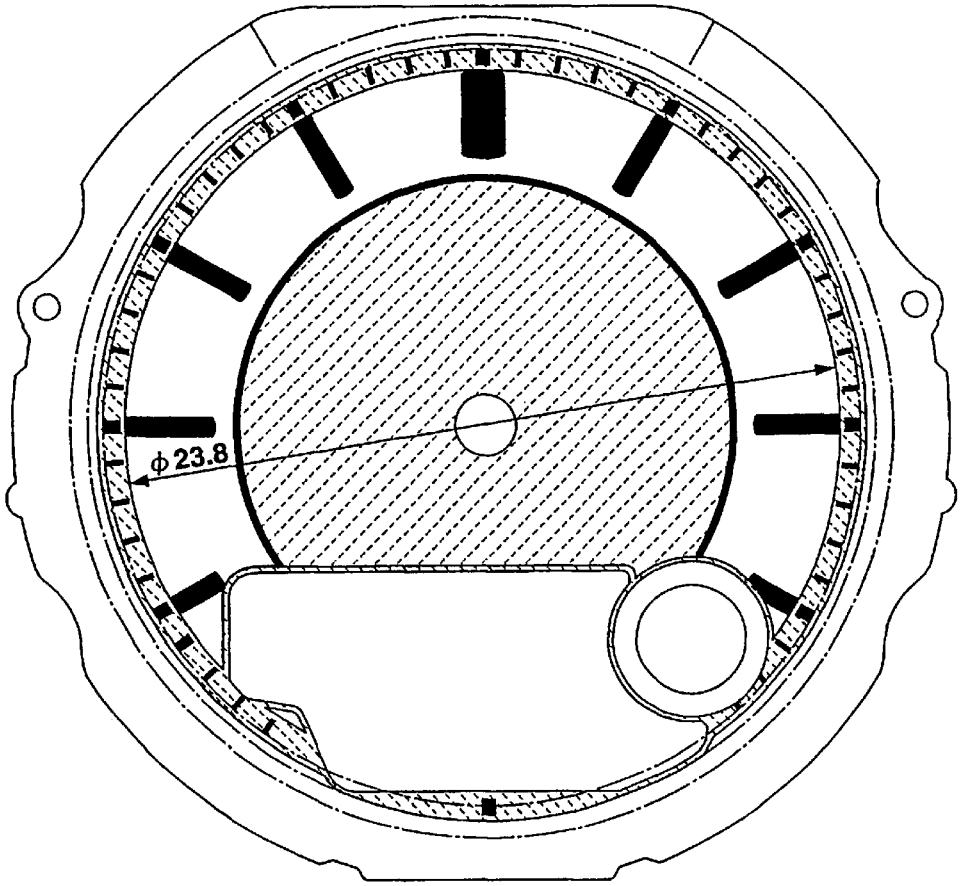
FIG. 12 is a front elevation showing a dial for a timepiece according to a third embodiment of the present invention applied to a wristwatch.
Figure 13:
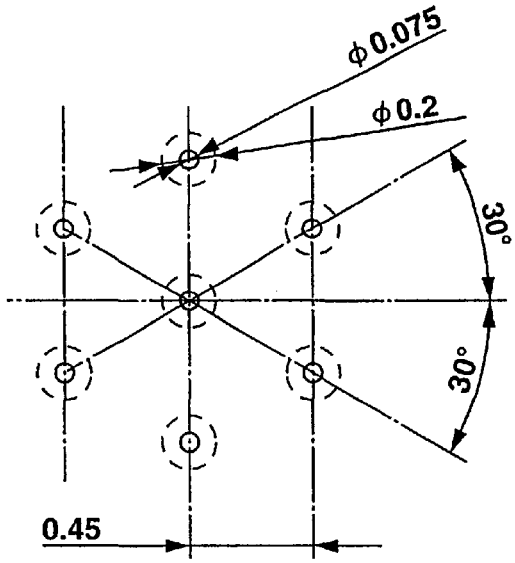
FIG. 13 is an enlarged view showing the central portion of the decoration member of FIG. 12.
Figure 14:
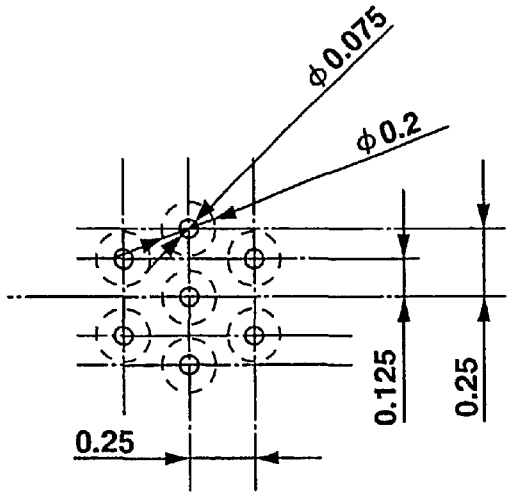
FIG. 14 is an enlarged view showing the peripheral portion of the decoration member of FIG. 12.

Next, a third embodiment of the present invention applied to a wristwatch will be explained with reference to FIG. 12 to FIG. 14. In these figures, the same reference numerals are attached to the same portions as the first embodiment shown in FIG. 1 and FIGS. 3A to 3D.

According to a dial for the wristwatch, the densities of through holes of a decoration member 41 differ between at the center portion 42 and at the peripheral portion 43. The holes are formed at the center and the vertexes of an equilateral hexagon, while the lines of the holes are arranged at intervals of 0.45 mm, at the center portion 42, as shown in FIG. 13. The holes are formed in a line at intervals of 0.25 mm, and the lines of the holes are arranged alternatively, at the peripheral portion 43, as shown in FIG. 14. Thus, it is possible to enhance the decoration effect by making the densities of the holes differ between at the center portion and at the peripheral portion, like the third embodiment.

According to the first to third embodiments and the modifications thereof as described above, the protective film 14 is provided on the decoration member 21, 31 or 41. However, it is not limited to this, and a light-transmissive color film may be provided instead. In this case, the color film may have a color or colors with patterns. Thereby, it is possible to illuminate by light with the color of the color film, because the light from the luminescent member 10 is transmitted through the color film. As a result, it is possible to offer an enhanced variety of decoration.

Moreover, according to the first to third embodiments and the modifications thereof described above, the present invention is applied to a wristwatch having an analogue function. However, it is not limited to this, and the invention can be applied to a wristwatch having a digital function or both of an analogue function and a digital function. Furthermore, the invention can be widely applied to timepieces, such as a table clock, an alarm clock, a travel watch, a wall clock or the like.

What is claimed is:

1. A dial for a timepiece, comprising:

a luminescent member; and a decoration member in which a plurality of through holes are formed vertically, the decoration member being disposed at an upper position of the luminescent member, wherein each of the through holes comprises an upper-side hole formed in an upper side of the decoration member and a lower-side hole that is connected to the upper-side hole and is formed in a lower side of the decoration member so that the cross-sectional area of the lower-side hole is larger than that of the upper-side hole.

2. The dial for a timepiece as claimed in claim 1, wherein the lower-side hole is formed to be large enough to correspond to a plurality of the upper-side holes.

3. The dial for a timepiece as claimed in claim 1, wherein one of a protective film having light permeability and a color film having light permeability is provided on an upper surface of the decoration member.

4. The dial for a timepiece as claimed in claim 1, wherein the densities of the through holes differ between at a center portion and at a peripheral portion of the decoration member.

5. The dial for a timepiece as claimed in claim 1, wherein the lower-side holes are formed to be deeper than the upper-side holes.

6. The dial for a timepiece as claimed in claim 1, wherein walls of the lower-side holes are formed to be oblique so that the diameter of the holes is larger at the lower surface side.

7. The dial for a timepiece as claimed in claim 2, wherein one of a protective film having light permeability and a color film having light permeability is provided on an upper surface of the decoration member.

8. The dial for a timepiece as claimed in claim 2, wherein the densities of the through holes differ between at a center portion and at a peripheral portion of the decoration member.

9. The dial for a timepiece as claimed in claim 2, wherein the lower-side holes are formed to be deeper than the upper-side holes.

10. The dial for a timepiece as claimed in claim 2, wherein walls of the lower-side holes are formed to be oblique so that the diameter of the holes is larger at the lower surface side.

11. A method for manufacturing a dial for a timepiece, comprising steps of:

providing masks comprising a plurality of openings on upper and lower surfaces of a substrate, an area of the openings on the upper surface being smaller than an area of the openings on the lower surface;

making a decoration member by forming a plurality of through holes in the substrate, the openings of the through holes at the upper surface being smaller than the openings of the through holes at the lower surface by etching the substrate having the masks on both surfaces from both sides; and mounting the decoration member at an upper position of a luminescent member.

12. The method for manufacturing a dial for a timepiece as claimed in claim 11, wherein the substrate is etched while a single opening of the mask on the lower surface corresponds to a plurality of the openings of the mask on the upper surface.

13. A timepiece comprising:

a case complete;

a dial for a timepiece placed inside the case complete; and a timepiece glass mounted in the case complete to be above the dial for a timepiece, wherein the dial for a timepiece comprises a luminescent member and a decoration member having lower and upper sides and a plurality of through holes formed vertically therein, the decoration member being provided at an upper position of the luminescent member; and wherein the through holes are formed so that the cross-sectional area of the lower-side holes is larger than that of the upper-side holes.

14. The timepiece as claimed in claim 13, wherein the lower-side hole is formed to be large enough to correspond to a plurality of the upper-side holes.

15. The timepiece as claimed in claim 13, wherein the dial for a timepiece comprises a protective film having light permeability or a color film having light permeability on the decoration member.

* * * * *